US008337049B2

(12) United States Patent
Shida et al.

(10) Patent No.: US 8,337,049 B2
(45) Date of Patent: Dec. 25, 2012

(54) BULB-TYPE LIGHTING SOURCE

(75) Inventors: Satoshi Shida, Osaka (JP); Takaari Uemoto, Osaka (JP)

(73) Assignee: Panasonic Corporation, Osaka (JP)

( * ) Notice: Subject to any disclaimer, the term of this patent is extended or adjusted under 35 U.S.C. 154(b) by 226 days.

(21) Appl. No.: 12/996,523

(22) PCT Filed: Jun. 30, 2009

(86) PCT No.: PCT/JP2009/003015

§ 371 (c)(1),
(2), (4) Date: Dec. 6, 2010

(87) PCT Pub. No.: WO2010/004702

PCT Pub. Date: Jan. 14, 2010

(65) Prior Publication Data

US 2011/0090699 A1 Apr. 21, 2011

(30) Foreign Application Priority Data

Jul. 7, 2008 (JP) ..... 2008-176916

(51) Int. Cl.
*F21V 29/00* (2006.01)

(52) U.S. Cl. ..... 362/294; 362/293; 362/184; 362/186; 362/800

(58) Field of Classification Search ..... 362/294, 362/184, 186, 197, 519, 546, 547, 548, 257, 362/264, 293, 800, 235, 363, 373, 376–378, 362/84, 85, 267, 310, 311.03, 311.06
See application file for complete search history.

(56) References Cited

U.S. PATENT DOCUMENTS

| | | | | |
|---|---|---|---|---|
| 6,465,961 | B1 * | 10/2002 | Cao | 315/58 |
| 6,949,772 | B2 | 9/2005 | Shimizu et al. | |
| 7,045,828 | B2 | 5/2006 | Shimizu et al. | |
| 7,250,637 | B2 | 7/2007 | Shimizu et al. | |
| 7,259,403 | B2 | 8/2007 | Shimizu et al. | |
| 7,375,381 | B2 | 5/2008 | Shimizu et al. | |
| 2003/0189829 | A1 | 10/2003 | Shimizu et al. | |
| 2004/0256630 | A1 * | 12/2004 | Cao | 257/98 |
| 2005/0207165 | A1 | 9/2005 | Shimizu et al. | |
| 2005/0237747 | A1 | 10/2005 | Shimizu et al. | |
| 2005/0242362 | A1 | 11/2005 | Shimizu et al. | |
| 2006/0098440 | A1 * | 5/2006 | Allen | 362/294 |
| 2006/0141851 | A1 | 6/2006 | Matsui et al. | |
| 2006/0160409 | A1 | 7/2006 | Shimizu et al. | |
| 2006/0227558 | A1 | 10/2006 | Osawa et al. | |

FOREIGN PATENT DOCUMENTS

| | | |
|---|---|---|
| JP | H06-86359 | 12/1994 |
| JP | 2002-093206 | 3/2002 |
| JP | 2002-299700 | 10/2002 |
| JP | 2003-124258 | 4/2003 |
| JP | 2003-124528 | 4/2003 |
| JP | 2004-265619 | 9/2004 |
| JP | 2005-038798 | 2/2005 |
| JP | 2005-166578 | 6/2005 |
| JP | 2005-294292 | 10/2005 |
| JP | 2006-313717 | 11/2006 |
| JP | 3142963 | 7/2008 |

* cited by examiner

*Primary Examiner* — Danielle Allen

(57) ABSTRACT

A bulb-type lighting source employs a light-emitting element in a structure that facilitates heat dispersal. The lighting source includes a first heat sink member mounted in a bowl shaped case supporting a power supply circuit. A mounting substrate is positioned in surface contact with a surface of the heat sink member and is capable of supporting a light-emitting unit. A globe covers the light-emitting unit to permit light emission. A second heat sink member has a surface in contact with a perimeter of the mounting substrate and offset from the light-emitting unit to provide a second part in surface contact with the first heat member to facilitate the release of heat.

9 Claims, 18 Drawing Sheets

1

Ver. 1

Heat sink: 200 $cm^3$
Heat dispersal from board bottom surface only

Ver. 2

Heat sink: 300 $cm^3$
Heat dispersal from board bottom surface only

Ver. 3

Heat sink: 300 $cm^3$
Heat dispersal from board bottom surface
and top surface

1

BULB-TYPE LIGHTING SOURCE

TECHNICAL FIELD

The present invention relates to a bulb-type lighting source that uses a light-emitting element such as an LED, and in particular to a technology for more effective heat dispersal from the light-emitting element.

Background Art

In recent years, research and development of technologies that employ light-emitting elements such as LEDs in lamps has progressed in the lighting field (see Patent Literature 1), and so bulb-type lighting sources that are alternatives to incandescent light bulbs have come under consideration (see Patent Literature 2 and 3). A bulb-type lighting source is sought that is restricted to external dimensions matching those of incandescent light bulbs for considerations of compatibility with lighting equipment, and also that can produce a total luminous flux suitable for use in lighting applications.

To produce a total luminous flux suitable for use in lighting applications, a rather high electrical power input must be applied to LEDs. As it happens, as electrical power input to an LED increases, so too does heat generated by the LED, thus leading to a rise in temperature. In an LED, high temperatures are accompanied by a drop in luminous efficacy. Therefore, the expected total luminous flux cannot be obtained through a simple increase in electrical power input. For this reason, standard practice is to place a large-volume heat sink member at the surface opposite the LED mounting surface of the LED mounting substrate (i.e. the bottom surface) in order to enhance the heat dispersal characteristics of the LED.

Citation List

Patent Literature

[Patent Literature 1]

Japanese Patent Application Publication No. 2005-038798

[Patent Literature 2]

Japanese Patent Application Publication No. 2003-124528

[Patent Literature 3]

Japanese Patent Application Publication No. 2004-265619

[Patent Literature 4]

Japanese Patent Application Publication No. 2005-294292

SUMMARY OF INVENTION

Technical Problem

Thus far, lamps that employ light-emitting elements such as LEDs have rarely assumed a structure with a sealed mounting substrate, and have obtained a heat dispersal effect by relying on natural cooling of the mounting substrate and of the heat sink member at the bottom surface of the mounting substrate.

However, in a bulb-shaped lighting source, a protective cover (globe) is required to cover the mounting substrate in order to allow use in ordinary domestic light fixtures. Thus, a heat dispersal effect through natural cooling cannot very well be expected. Also, as mentioned above, there is a limit on the volume of the heat sink member at the bottom surface of the mounting substrate because the external dimensions of bulb-shaped lighting sources are restricted. If a bulb-shaped lighting source is to use light-emitting elements such as LEDs in this way, the heat dispersal structure must be taken into consideration due to such various limitations.

The present invention has been achieved in view of the above problems, and an aim thereof is to provide a bulb-type lighting source that employs a light-emitting element and that has better heat dispersal characteristics than the conventional technology.

Solution to Problem

In order to solve the above problems, the present invention provides a bulb-type lighting source that receives electric power supplied via a base, comprising: a bowl-shaped case which accommodates a power supply circuit in an inner space thereof and to which the base is attached, a first heat sink member that closes a mouth of the bowl-shaped case, a mounting substrate that is in surface contact with a front surface of the first heat sink member opposite a rear surface of the first heat sink member that faces the inner space of the bowl-shaped case, a light-emitting unit that is mounted on a front surface of the mounting substrate opposite a rear surface of the mounting substrate which is in surface contact with the first heat sink member and that includes (i) a light-emitting element that emits light upon receiving electric power supplied by the power supply circuit and (ii) a wavelength conversion element that converts wavelengths of the light emitted by the light-emitting element, a globe that at least covers the light-emitting unit in light emission directions thereof, a second heat sink member that has a first part in surface contact with a region of the front surface of the mounting substrate where the light-emitting unit is not mounted and that has a second part in surface contact with the first heat sink member.

Advantageous Effects of Invention

According to research concerning heat sink structure, the inventors discovered that when a heat dispersal pathway originating at the light-emitting element mounting surface of a mounting substrate is secured, better heat dispersal characteristics can be obtained than by simply placing a large-volume heat sink at the surface opposite the light-emitting element mounting surface. The present invention, created according to this new knowledge, secures a heat dispersal pathway originating at the light-emitting element mounting surface of the mounting substrate by providing a second heat sink. According to this structure, a bulb-type lighting source with better heat dispersal characteristics than the conventional technology can be obtained.

DESCRIPTION OF EMBODIMENTS

A preferred embodiment of the present invention is described below with reference to the drawings.

(Structure)

Figure 1:
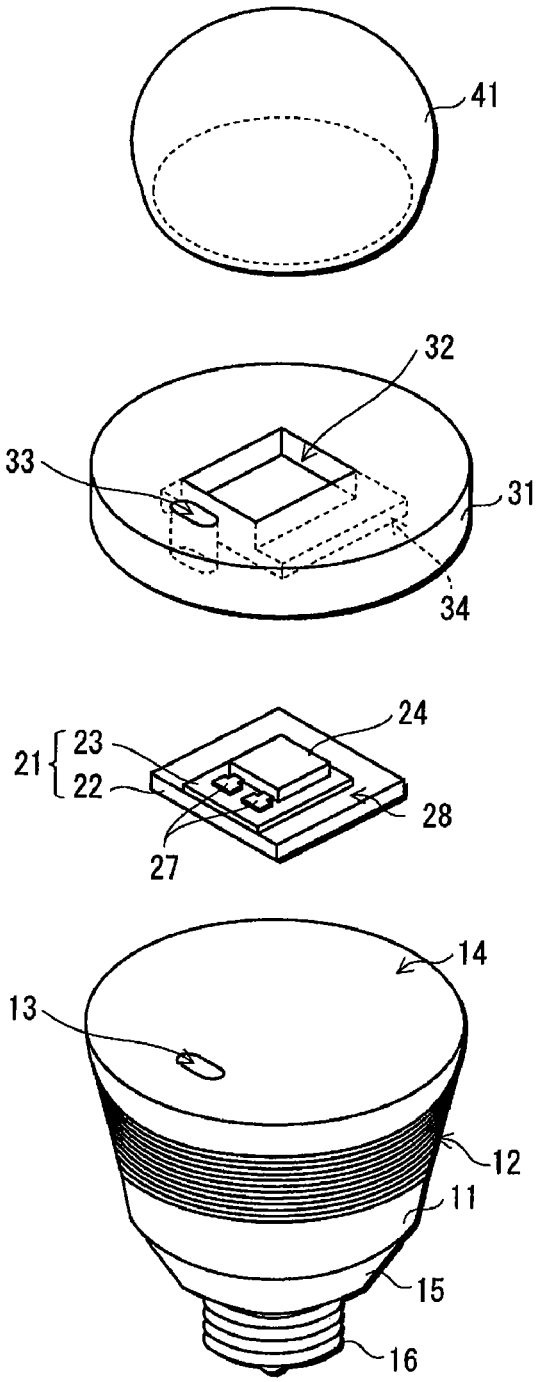
FIG. 1 shows an exploded perspective view of the structure of the lamp pertaining to the embodiment of the present invention.
Figure 2:
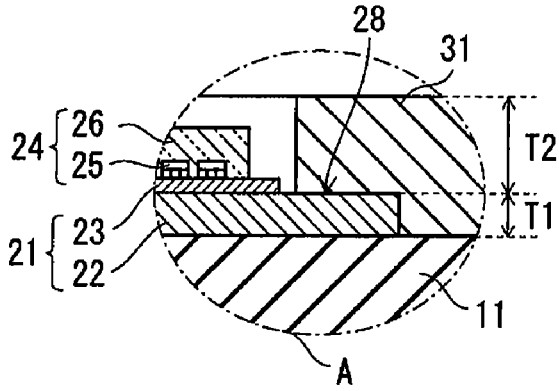
FIG. 2 shows a cross-section of the structure of the lamp pertaining to the embodiment of the present invention.
Figure 2:
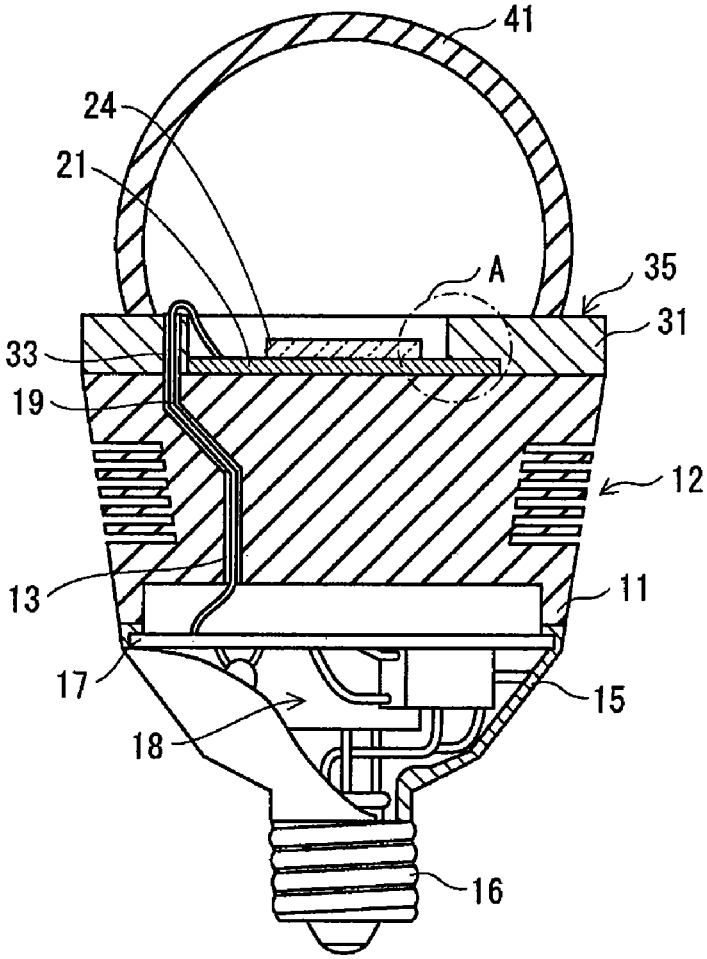

FIG. 1 is an exploded perspective view showing the structure of the lamp pertaining to the present embodiment. FIG. 2 is a cross-sectional diagram showing the structure of the lamp pertaining to the present embodiment.

As shown in FIG. 1, the lamp 1 includes a bowl-shaped case 15 to which the an Edison screw 16 is attached, a heat sink member 11 that closes the mouth of the case 15, a mounting substrate 21 placed on the top surface (the surface opposite the surface that closes the mouth) 14 of the heat sink member 11, a light-emitting unit 24 placed on the top surface (the surface opposite the surface that is in contact with the heat sink member 11) of the mounting substrate 21, a heat sink member 31 that is placed on the top surface 14 of the heat sink member 11, and a globe 41 that is fixed to the heat sink member 31 and covers the light-emitting unit 24 in the light emission direction thereof. Further, as shown in FIG. 2, the inside of the case 15 accommodates in an inner space thereof a power supply circuit 18 that supplies commercial power through the Edison screw 16 to the light-emitting unit 24. The power supply circuit 18 is made up of several electronic components mounted on a printed circuit board 17. The printed circuit board 17 is fixed to the interior of the case 15. The power supply circuit 18 and the light-emitting unit 24 are electrically connected through a wire 19. The wire 19 is passed through a through-hole 13 in the heat sink member 11 and through a through-hole 33 in the heat sink member 31. The case 15 is made of plastic, ceramic, or similar electrically insulating material. It should be noted that the bowl shape here designates any shape such that the end opposite the end from which the Edison screw 16 protrudes forms a mouth and is not particularly limited to a shape with a round mouth.

The heat sink member 11 is made of a metal such as anodized aluminum in an approximately circular truncated cone shape where the side portions form fins 12 and where the top surface 14 is flat. In addition, a through-hole 13 is provided to allow a wire to be introduced.

The mounting substrate 21 is constructed from a metal substrate 22 that is made of aluminum, copper, or other metal and an insulating layer 23 that is made of plastic, ceramic or other insulator and which is layered on the top surface (the surface opposite the surface that is in contact with the heat sink member 11) of the metal substrate 22. The light-emitting unit 24 and electrode pads 27 are mounted on the insulating layer 23. The perimeter 28 of the top surface of the mounting substrate 21 is the region in which the light-emitting unit 24 is not placed. The perimeter 28 has no insulating layer 23 and so the top surface of the metal substrate 22 is exposed.

The light-emitting unit 24 is composed of an LED 25 and a silicone resin body 26 (see FIG. 2, enlargement A). The LED 25 is a light-emitting element that emits blue light. The silicone resin body 26 contains yellow phosphors and functions as a wavelength conversion element by converting blue light into yellow light.

The heat sink member 31 is made of a metal such as anodized aluminum and is shaped like a roughly circular flat disc where the bottom surface has a recess 34. A portion of the recess 34 continues through to the top surface of the disc, thus forming an aperture 32. The bottom surface of the heat sink member 31 is in surface contact with the top surface 14 of the heat sink member 11. The recess 34 of the heat sink member 31 is shaped so that the mounting substrate 21 can be accommodated therein while the perimeter 28 of the top surface of the mounting substrate 21 remains in surface contact. Also, the aperture 32 of the heat sink member 31 is shaped so as to accommodate the light-emitting unit 24.

The globe 41 is made of a translucent material such as plastic or glass, and is attached to the heat sink member 31 in such a manner that the light-emitting unit 24 and the mounting substrate 21 are covered from the top in order to protect the light-emitting unit 24 and the mounting substrate 21 from direct contact by a user and from scattered water or the like. It should be noted that attaching the globe 41 to the top surface of the heat sink member 31 is accomplished by joining the two with a thermally conducting joining material, or else by inserting a screw into a screw groove in the heat sink member 31. The perimeter 35 of the heat sink member 31 is the portion that is not covered by the globe 41 and that is in contact with outside air (see FIG. 2).

The relationship between the heat sink member 31 and the mounting substrate 21 is explained below.

Figure 3:
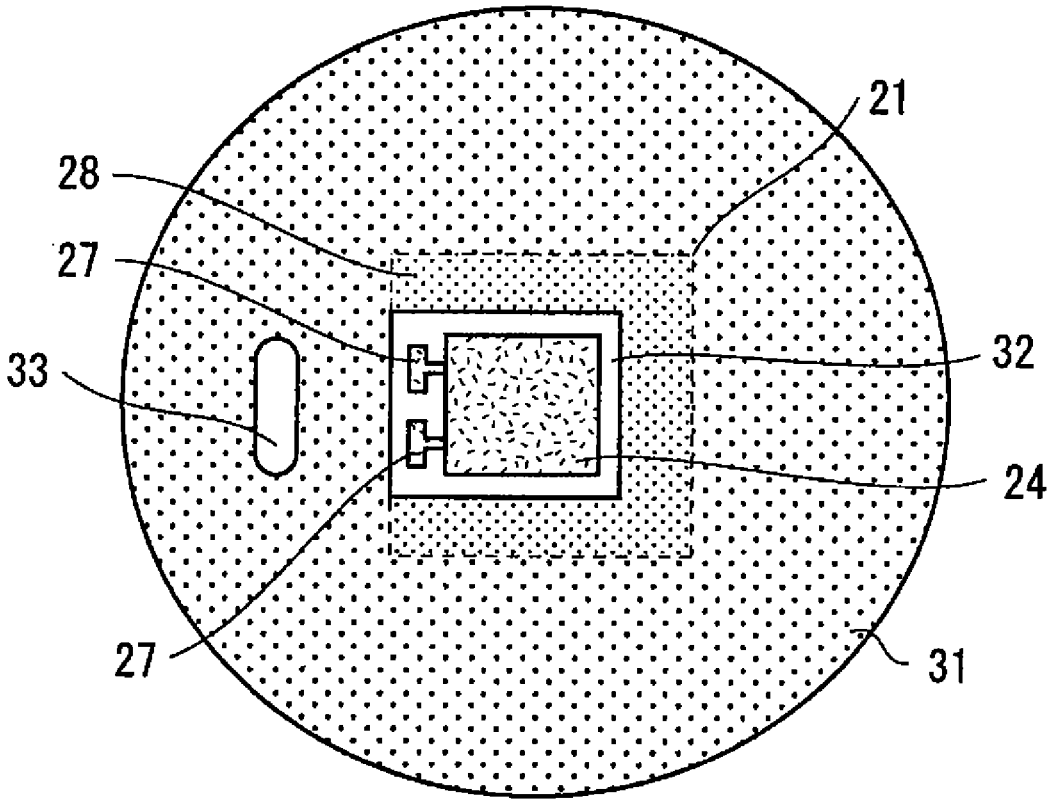
FIG. 3 shows a top view explaining the contact zone between the heat sink member and the mounting substrate.

FIG. 3 is a diagram showing a top view of the contact zone between the heat sink member 31 and the mounting substrate 21.

According to the present embodiment, the contact area between the mounting substrate 21 and the heat sink member 31 is greater than the area on which the heat source, namely the light-emitting unit 24, is placed. The rise in temperature of the light-emitting unit 24 can be substantially inhibited by widening the contact area between the mounting substrate 21 and the heat sink member 31 in this way.

In addition, the mounting substrate 21 is a quadrilateral when seen from above. The heat sink member 31 is in surface contact with three sides of the perimeter 28 of the mounting substrate 21. Using a metal-based mounting substrate as the mounting substrate on which to place the light-emitting unit, better heat dispersal characteristics can be obtained in comparison to using a ceramic base. However, a metal-based mounting substrate has a drawback in that, when there is a temperature difference between the top surface and the bottom surface, internal stresses caused by differential thermal expansion lead to warpage. Should warpage of the mounting substrate occur, the contact area between the bottom surface of the mounting substrate and the heat sink member will be reduced, and the heat dispersal characteristics deteriorate. According to the present embodiment, the heat sink member 31 is in surface contact with the top surface of the mounting substrate 21 and thus, temperature differences between the top surface and the bottom surface of the mounting substrate 21 are inhibited, and even if internal stresses are caused by a difference in temperature, warpage can be controlled by the downward press on the top surface of the mounting substrate 21. Furthermore, according to the present embodiment, the heat sink member 31 is in surface contact with three sides of the perimeter 28 of the mounting substrate 21 and thus can enhance the effective control of any warpage in the mounting substrate 21.

In addition, according to the present embodiment, the thickness T2 of the portion of the heat sink member 31 that is in surface contact with the top surface of the mounting substrate 21 is greater than the thickness T1 of the mounting substrate 21 (see FIG. 2, enlargement A). Increasing the thickness T2 of the heat sink member 31 in this way can enhance the stiffness of the heat sink member 31 which in turn can further enhance the effective control of any warpage in the mounting substrate 21.

In addition, according to the present embodiment, the heat sink member 31 is in direct contact with the metal substrate 22 without involving the insulating layer 23 (see FIG. 2, enlargement A). Accordingly, thermal resistance at the interface between the mounting substrate 21 and the heat sink member 31 can be reduced, and thus better heat dispersal characteristics can be achieved.

Figure 4:
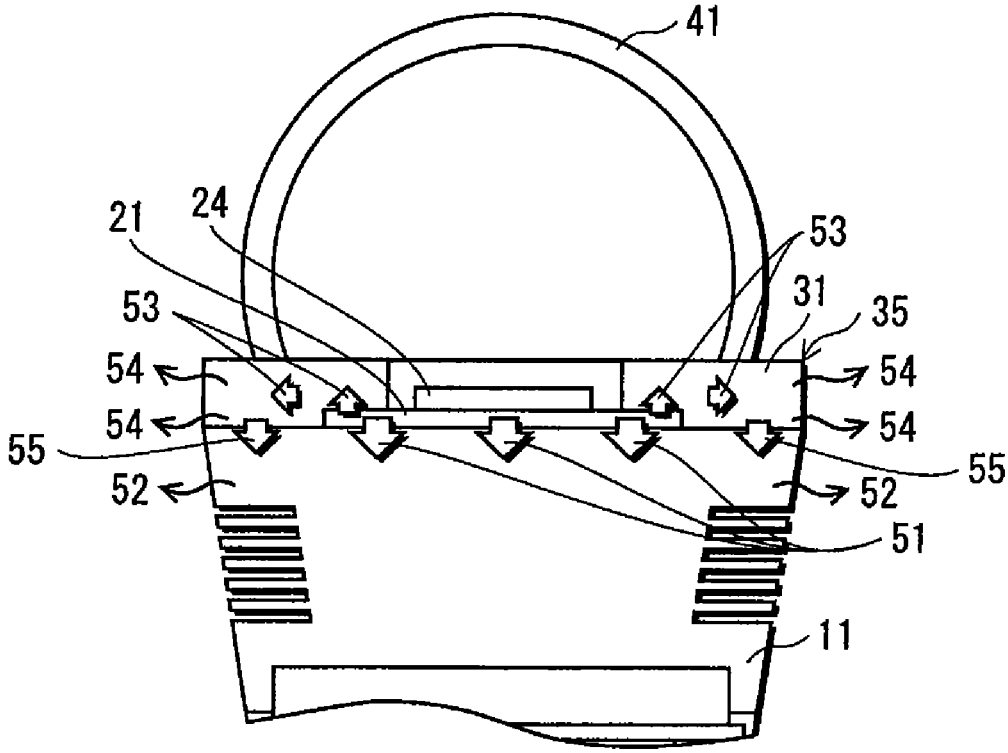
FIG. 4 shows the heat dispersal pathways of the lamp pertaining to the embodiment of the present invention.

FIG. 4 is a diagram showing the heat dispersal pathways of the lamp pertaining to the present embodiment.

The mounting substrate 21 has the following heat dispersal pathways: a pathway which originates at the bottom surface and in which heat is conducted to the heat sink member 11 (reference sign 51) and the heat sink member 11 is naturally cooled (reference sign 52); a pathway which originates at the top surface and in which heat is conducted to the heat sink member 31 (reference sign 53) and the heat sink member 31 is naturally cooled (reference sign 54); and a pathway which originates at the top surface and in which heat is conducted to the heat sink member 31 (reference sign 53), then heat is conducted by the heat sink member 31 to the heat sink member 11 (reference sign 55) and the heat sink member 11 is naturally cooled (reference sign 52). Thus, according to the present embodiment, not only the bottom surface but also the top surface of the mounting substrate 21 are both at the origin of heat dispersal pathways.

The heat dispersal characteristics of the heat dispersal pathway originating at the top surface of the mounting substrate 21 are validated below according to experimental results.

(Validation)

The inventors first conducted an experiment concerning changes in the heat dispersal characteristics exhibited along with changes in the enveloping volume of a heat sink member placed at the bottom surface of a mounting substrate.

Figure 5:
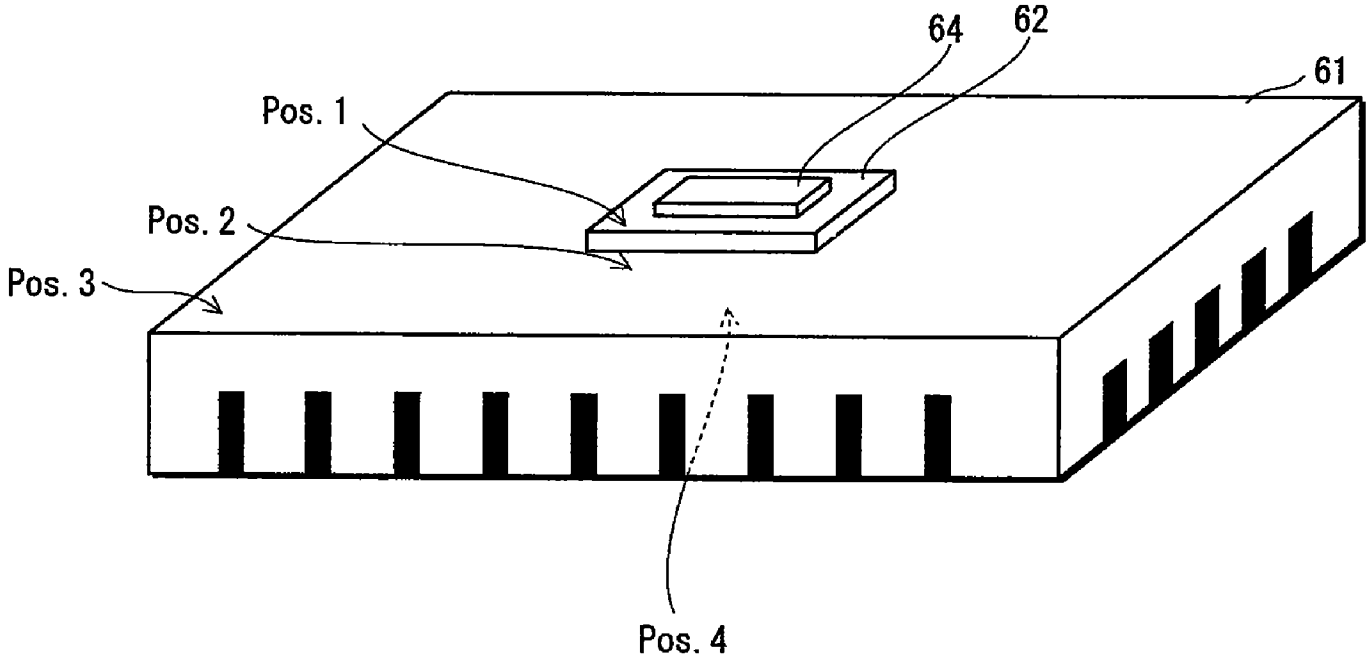
FIG. 5 schematically shows the experimental system for the heat dispersal characteristics.

FIG. 5 is a diagram schematically illustrating the experimental system for the heat dispersal characteristics.

The sample LED module is prepared by placing a light-emitting unit 64 on a mounting substrate 62. The heat sink member 61 is placed at the bottom surface of the mounting substrate 62. An aluminum substrate is used for the mounting substrate 62 and an LED chip 1.0 mm square is used as the light-emitting element of the light-emitting unit 64. Twelve LED chips are flip-chip mounted on the aluminum substrate.

In this experimental system, four types of heat sink member, differing by enveloping volume, were prepared (enveloping volumes: 54 $cm^3$, 208 $cm^3$, 1108.8 $cm^3$, 2625 $cm^3$). When current was applied to the light-emitting unit 64, the temperature was measured at each of four positions (Pos. 1 at the top surface of the sample, Pos. 2 at the top surface of the heat sink member next to the sample, Pos. 3 at the edge of the top surface of the heat sink member, Pos. 4 at the bottom surface of the heat sink member) and the LED chip junction temperature $T_j$ was also measured. The current applied to the light-emitting unit 64 was one of three types, measuring 100 mA, 150 mA, and 200 mA, respectively.

Figure 6A:
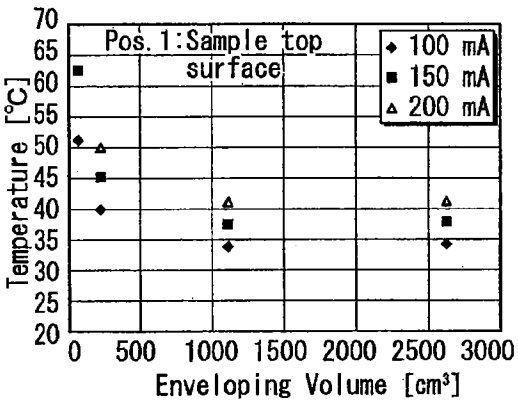
FIGS. 6A through 6E show graphs of the temperatures measured at each position as well as the junction temperatures.
Figure 6B:
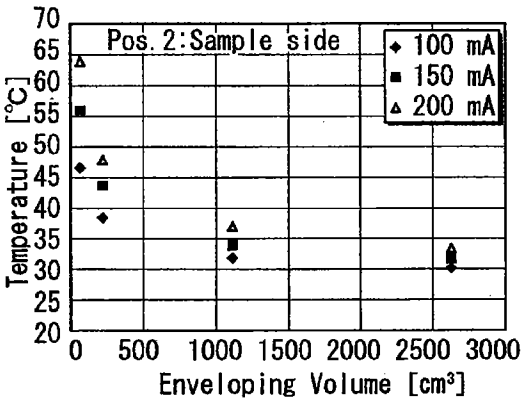
Figure 6C:
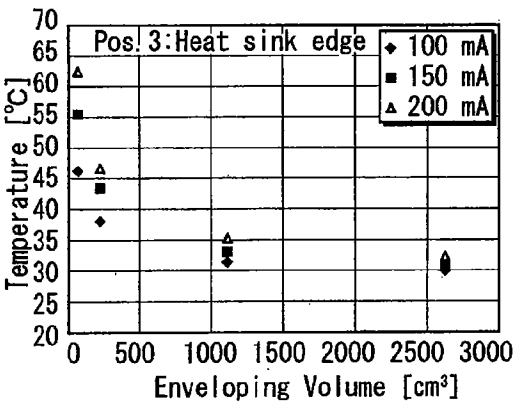
Figure 6D:
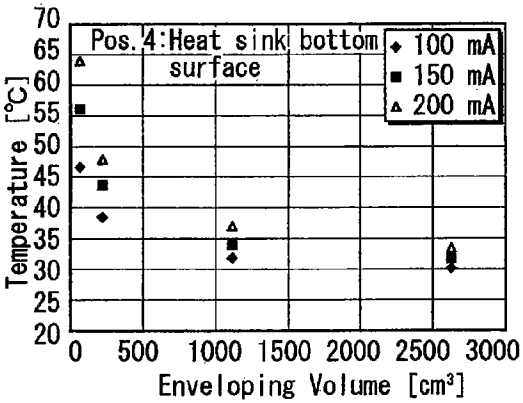
Figure 6E:
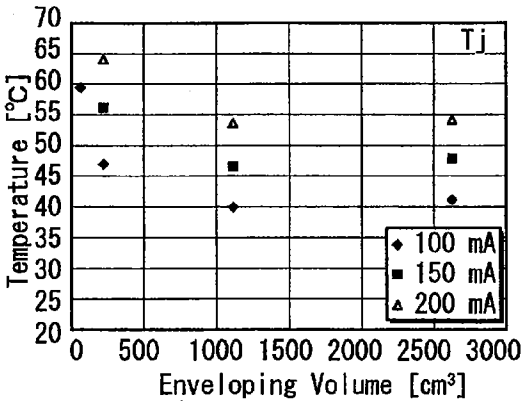

FIGS. 6A through 6E show graphs indicating the temperatures measured at each position as well as the junction temperatures, where FIG. 6A shows the temperatures at Pos. 1 at the top surface of the sample, FIG. 6B shows the temperatures at Pos. 2 at the top surface of the heat sink member next to the sample, FIG. 6C shows the temperatures at Pos. 3 at the edge of the top surface of the heat sink member, FIG. 6D shows the temperatures at Pos. 4 at the bottom surface of the heat sink member, and FIG. 6E shows the LED chip junction temperatures.

From these results, it is understood that the temperature at each position decreases as the enveloping volume of the heat sink member that is placed at the bottom surface of the mounting substrate increases. However, the effect of the drop in temperature obtained by increasing the enveloping volume diminishes along with the increasing enveloping volume. For example, a tremendous drop in temperature can be obtained at Pos. 1 at the top surface of the sample by changing the enveloping volume of the heat sink member from 54 $cm^3$ to 208 $cm^3$. Yet, hardly any drop in temperature can be obtained by changing the enveloping volume of the heat sink member from 1108.8 $cm^3$ to 2625 $cm^3$. This trend can be observed at Pos. 2 next to the sample, at Pos. 3 at the edge of the top surface of the heat sink member, and at Pos. 4 at the bottom surface of the heat sink member, but is particularly striking at Pos. 1 at the top surface of the sample. Also, the same trend seen at Pos. 1 at the top surface of the sample can be seen in the junction temperature $T_j$.

From the above, it is understood that while it is possible to obtain a decrease in temperature by increasing the enveloping volume of the heat sink member that is placed at the bottom surface of the mounting substrate, there is a limit to this effect. Given that the heat dispersal effect is constrained by the enveloping volume of the heat sink member when that volume is small, it can be surmised that when the enveloping volume reaches a certain value, the heat dispersal effect is constrained by the contact area between the mounting substrate and the heat sink member. Upon reaching these results, the inventors conducted an experiment concerning changes in the heat dispersal characteristics exhibited along with changes in the contact area between the mounting substrate and the heat sink member while the enveloping volume of the heat sink member is held constant.

Figure 7A:
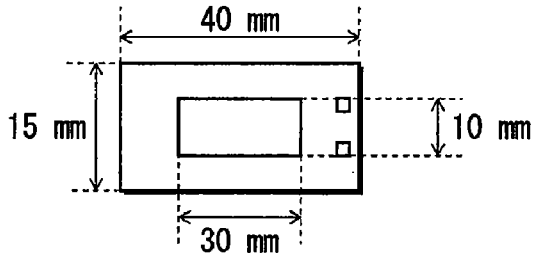
FIGS. 7A through 7D schematically show the experimental system for the heat dispersal characteristics.
Figure 7B:
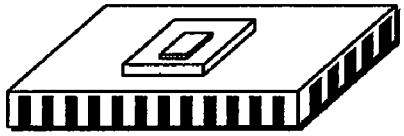
Figure 7C:
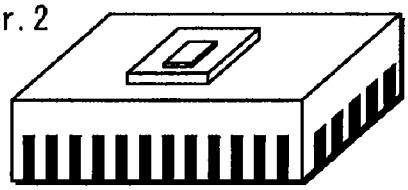
Figure 7D:
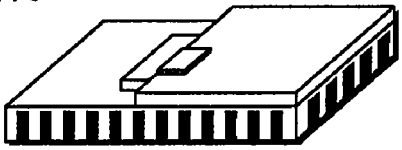

FIGS. 7A through 7D are diagrams schematically illustrating the experimental system for the heat dispersal characteristics, where FIG. 7A shows the sample dimensions of the LED module, FIG. 7B shows version 1 of the system, FIG. 7C shows version 2 of the system, and FIG. 7D shows version 3 of the system.

In version 1, the heat sink member is placed only at the bottom surface of the mounting substrate, and the enveloping volume of the heat sink member is 200 $cm^3$. In version 2, the heat sink member is placed only at the bottom surface of the mounting substrate, and the enveloping volume of the heat sink member is 300 $cm^3$. In version 3, the heat sink member is placed at the bottom surface and at the top surface of the mounting substrate, and the enveloping volume of the heat sink member is 300 $cm^3$.

Figure 8:
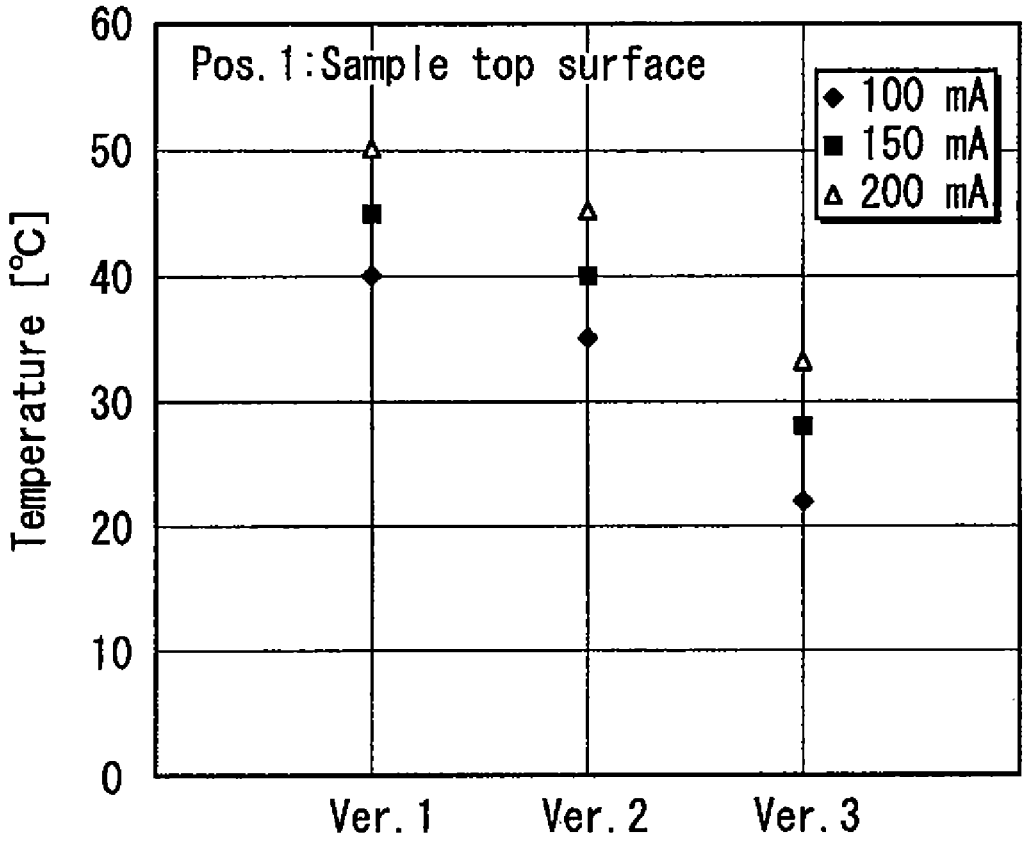
FIG. 8 shows a graph of the temperatures measured for each version.

FIG. 8 is a graph showing the temperatures that were measured for each version.

Comparing version 1 to versions 2 and 3, it is understood that changing the enveloping volume of the heat sink member from 200 $cm^3$ to 300 $cm^3$ caused a drop in sample top surface temperature. Further comparing version 2 and version 3, it is understood that even when the enveloping volume of the heat sink member is held constant at 300 $cm^3$, a greater drop in sample top surface temperature occurs in version 3, where the heat sink member is placed at the bottom surface and at the top surface of the mounting substrate, in contrast to version 2, where the heat sink member is placed only at the bottom surface of the mounting substrate. That is, it is understood that when a heat dispersal pathway (thermal transmission pathway) originating at the top surface of the mounting substrate is secured, better heat dispersal characteristics can be obtained than by simply increasing the enveloping volume of a heat sink member placed at the bottom surface of the mounting substrate.

Version 1 and version 2 above correspond to conventional technology, and version 3 corresponds to the present embodiment. Thus, according to the present embodiment, better heat dispersal characteristics than those of conventional technologies can be obtained, and this can in turn contribute to the miniaturization of the lamp.

Figure 9:
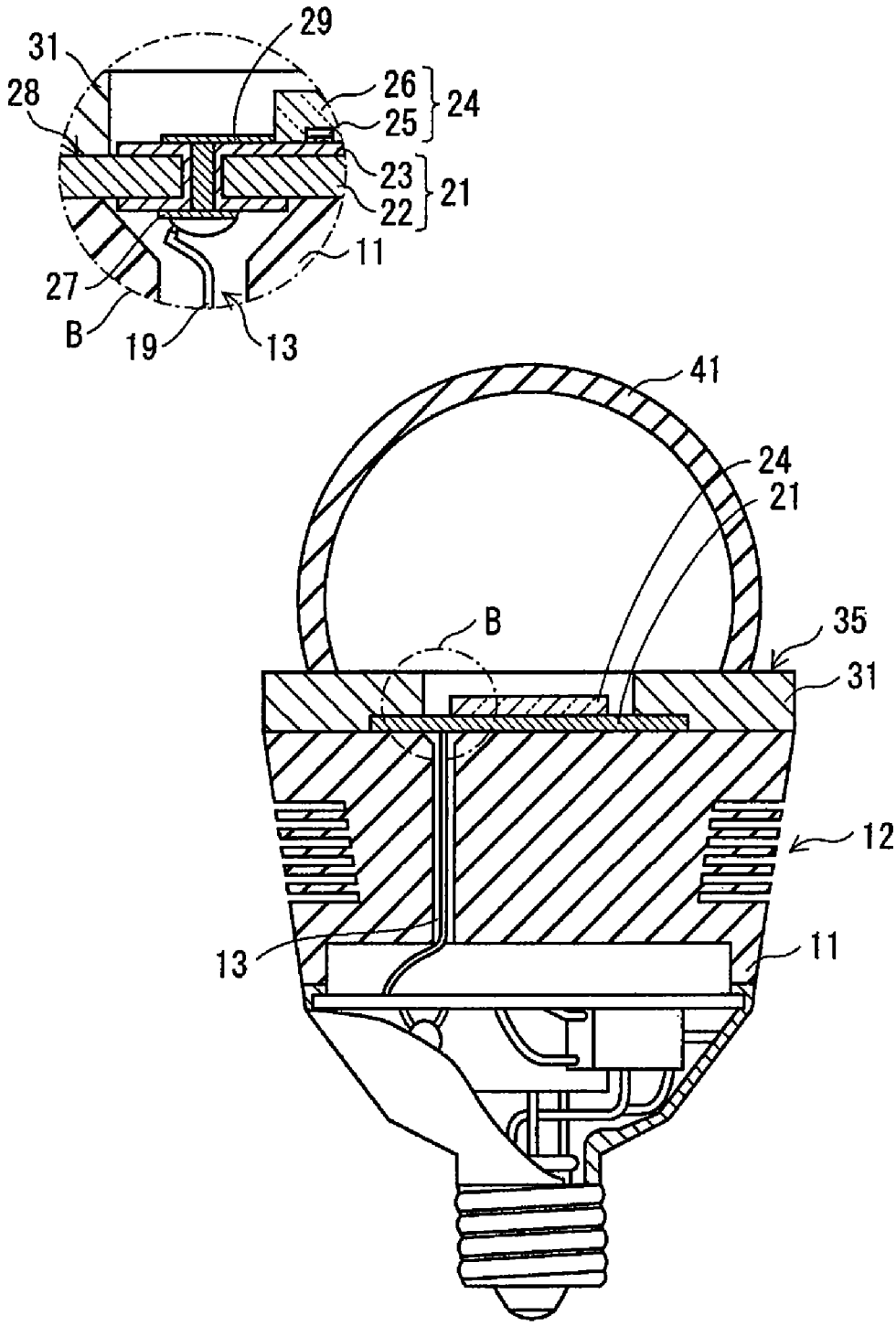
FIG. 9 shows a cross-section of the structure of the lamp pertaining to a variation of the present invention.
Figure 10:
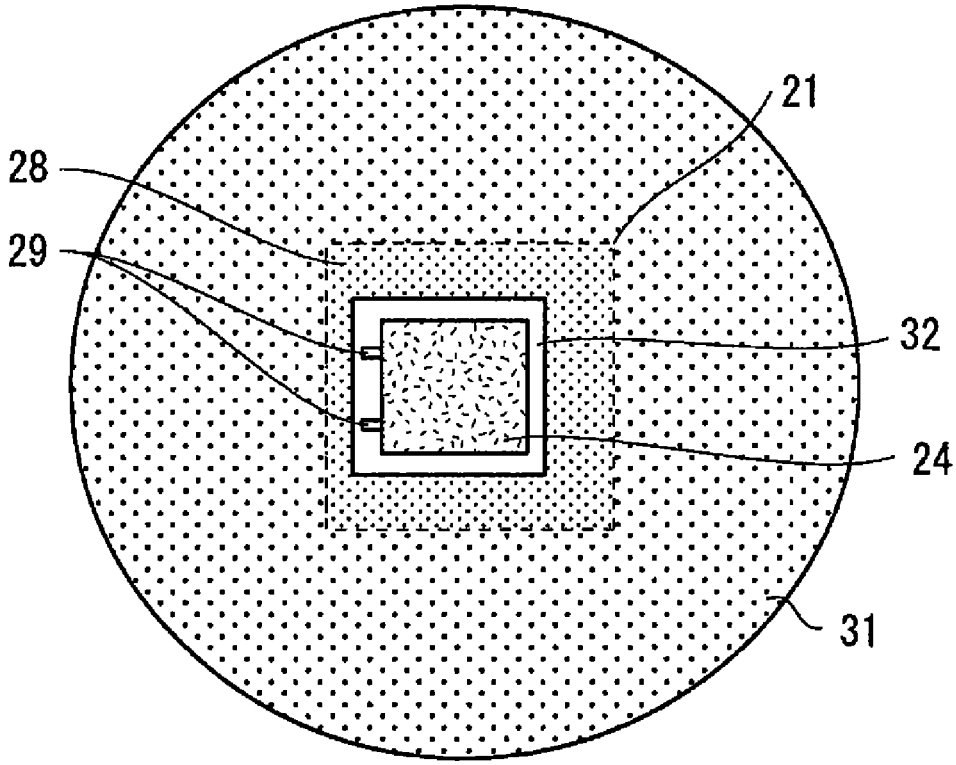
FIG. 10 shows a top view explaining the contact zone between the heat sink member and the mounting substrate.
Figure 11:
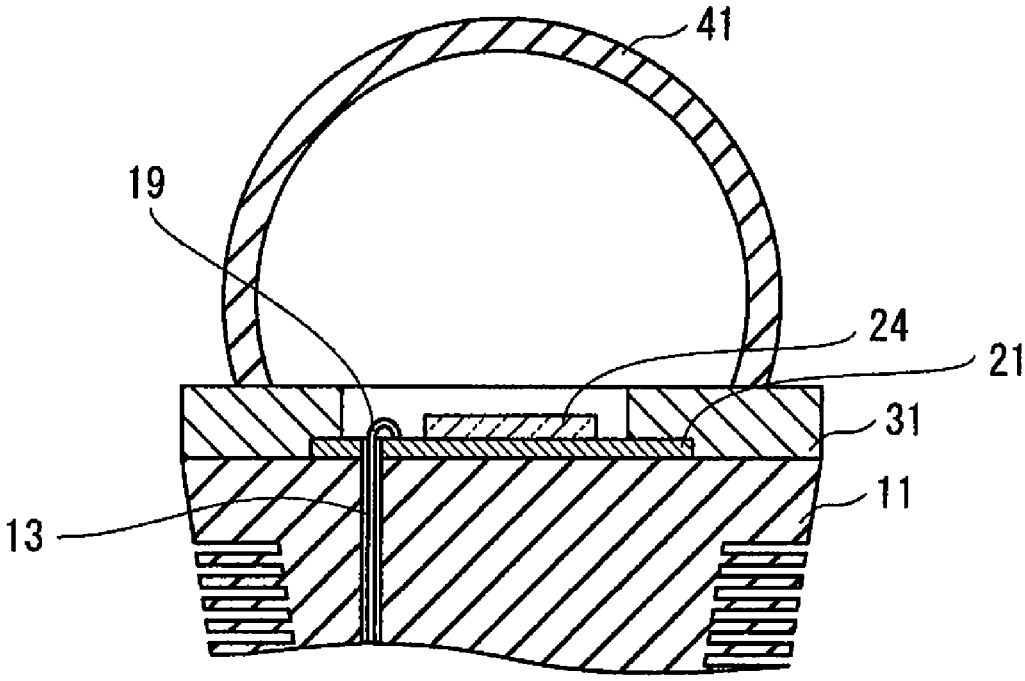
FIG. 11 shows a cross-section of the structure of the lamp pertaining to a variation of the present invention.

The lamp pertaining to the present invention was described above according to a single embodiment, but the present invention is not limited to this embodiment. For example, the following variations are plausible:

1) In the present embodiment, the electrode pads 27 are placed on the top surface of the mounting substrate 21, and the wire 19 is connected to the electrode pads 27 on the top surface of the mounting substrate 21. However, the present invention is not limited in this way. For example, as shown in FIG. 9, the electrode pads 27 may be placed on the bottom surface of the mounting substrate 21, the wiring pattern 29 and the electrode pads 27 may be electrically connected through a through-hole, and the wire 19 may be connected to the electrode pads 27 on the bottom surface of the mounting substrate 21. This arrangement makes possible the enlargement of the region of the top surface of the mounting substrate 21 in which the light-emitting unit is not placed, as shown in FIG. 10. This in turn allows the heat sink member 31 to be placed in quadrilateral surface contact with the mounting substrate 21. Also, as shown in FIG. 11, there may be a through-hole going through the mounting substrate 21 from the top surface to the bottom surface, and the wire 19 may be passed through this through-hole.

Figure 12B:
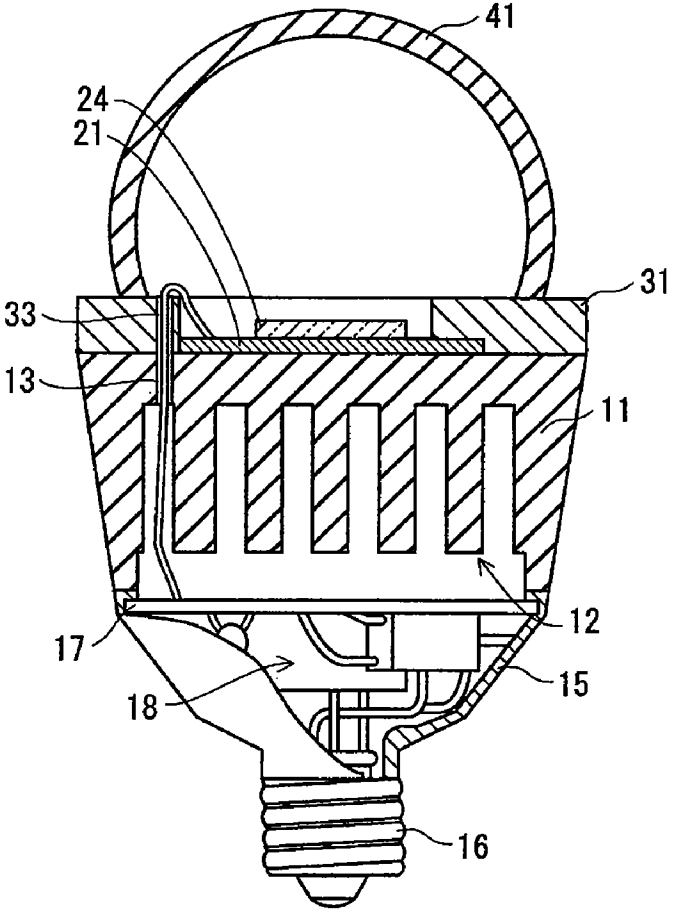
FIGS. 12A and 12B show cross-sections of the structure of lamps pertaining to variations of the present invention.
Figure 12A:
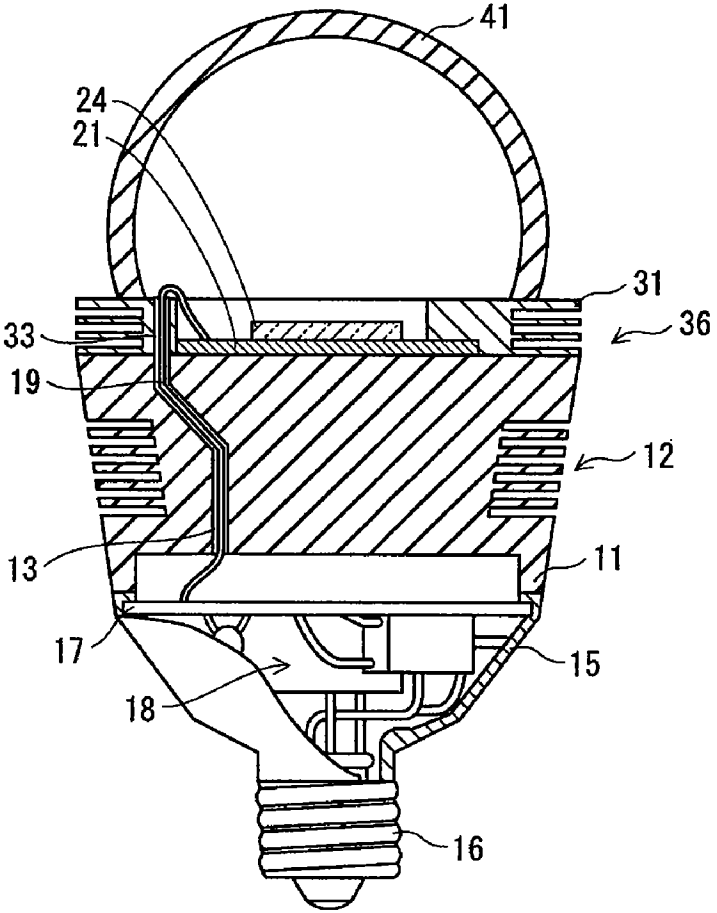

2) In the present embodiment, the heat sink member 31 has no fins. However, the present invention is not limited in this way. For example, as shown in FIG. 12A, the side portions of the heat sink member 31 may have fins 36. Also, in the present embodiment, the side portions of the heat sink member 11 have fins. However, the present invention is not limited in this way. For example, as shown in FIG. 12B, the inside of the heat sink member 11 may have fins 12.

Figure 13A:
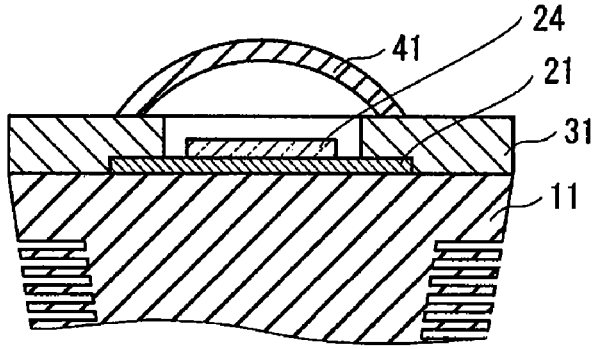
FIGS. 13A through 13C show cross-sections of the structure of lamps pertaining to variations of the present invention.
Figure 13B:
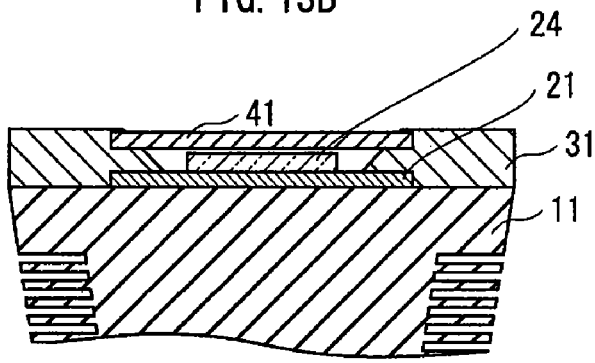
Figure 13C:
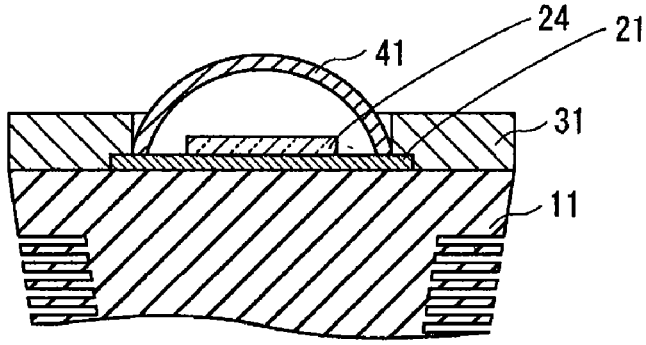

3) In the present embodiment, the globe 41 is in a shaped to resemble a light bulb. However, the present invention is not limited in this way. For example, as shown in FIGS. 13A through 13C, the globe 41 may be made as small as possible in order to increase the portion of the heat sink member 31 that is in contact with ambient air.

Figure 14:
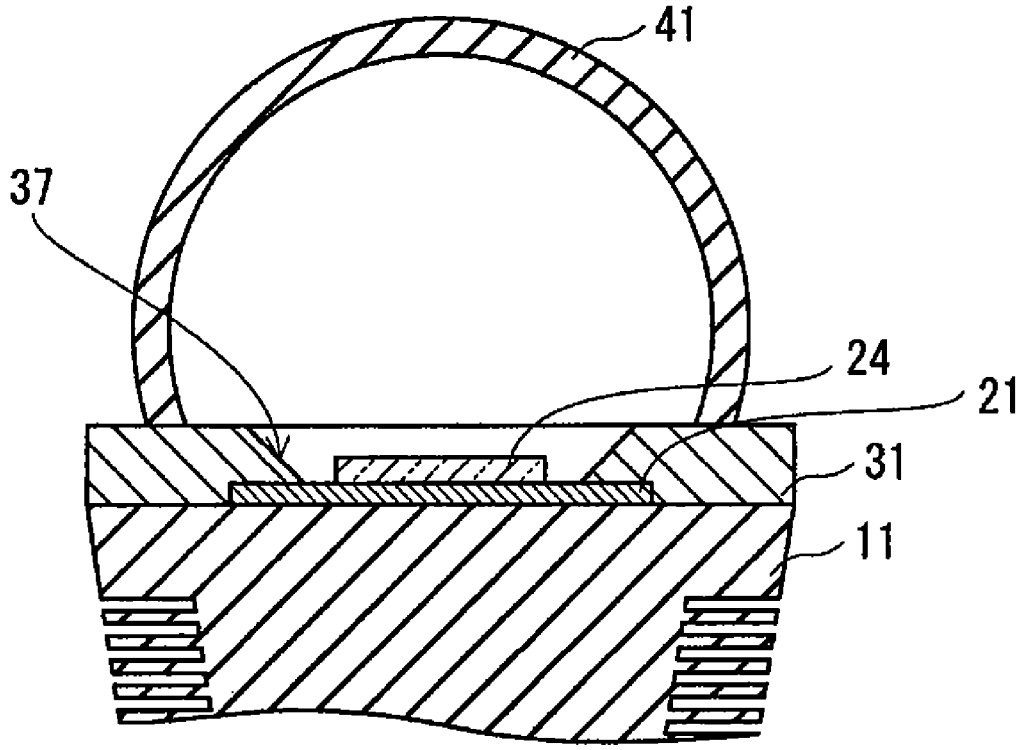
FIG. 14 shows a cross-section of the structure of the lamp pertaining to a variation of the present invention.

4) In the present embodiment, the inner circumference of the aperture of the heat sink member 31 is uniform at all points. However, the present invention is not limited in this way. For example, as shown in FIG. 14, the aperture may have an inner surface 37 that widens as it approaches the top surface of the heat sink member. In this manner, light output efficacy may be increased.

5) In the present embodiment, a metal-based mounting substrate is used. However, the present invention is not limited in this way. For example, a ceramic substrate equivalent to the aluminum substrate may be used to produce the same effect.

6) In the present embodiment, the top surface of the heat sink member 11 is flat and the bottom surface of the heat sink member 31 has a recess to accommodate therein the mounting substrate 21. However, the present invention is not limited in this way. For example, the top surface of heat sink member 11 may have a recess to accommodate therein the mounting substrate 21, and the heat sink member 31 may only have an aperture to accommodate the light-emitting unit 24 and allow light output. Also, the top surface of the heat sink member 11 and the bottom surface of the heat sink member 31 may both have a recess so that the mounting substrate 21 can be accommodated in both recesses.

Figure 15:
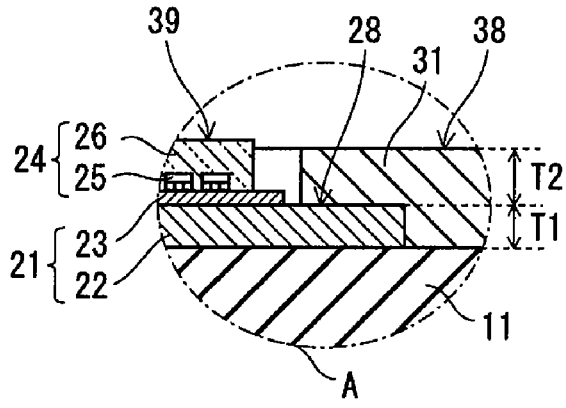
FIG. 15 shows a cross-section of the structure of the lamp pertaining to a variation of the present invention.
Figure 15:
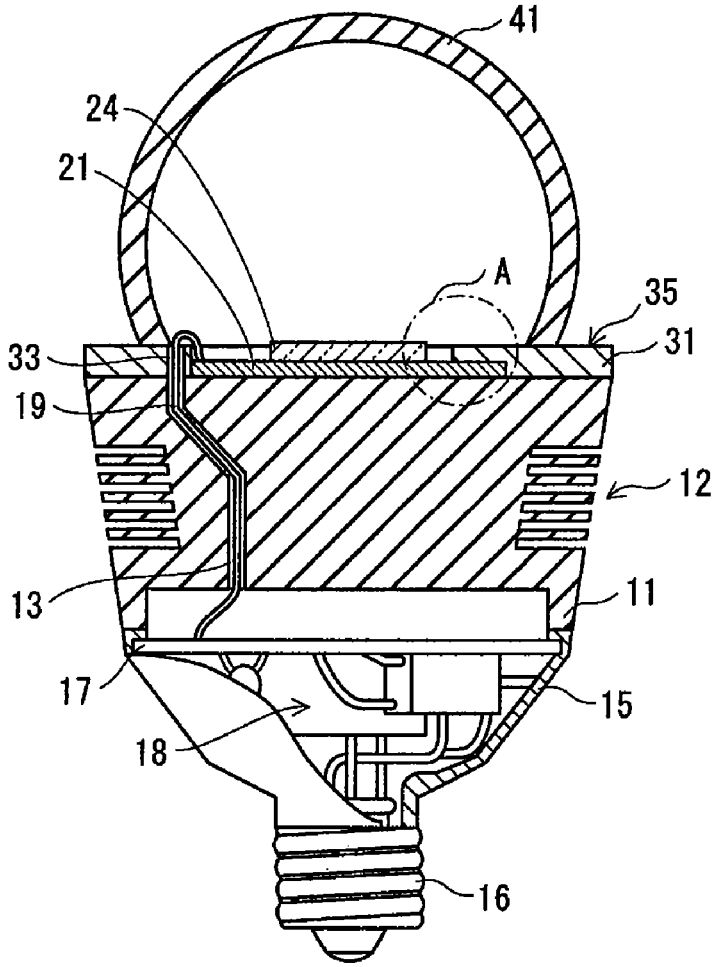

7) In the present embodiment, the light-emitting unit 24 is accommodated completely within the aperture of the heat sink member 31. However, the present invention is not limited in this way. For example, as shown in FIG. 15, the surface 39 of the top part of the light-emitting unit 24 may protrude beyond the surface 38 of the heat sink member 31 in a perpendicular direction from the insulating base 21. In this manner, the light output efficacy may be increased. It should be noted that in this configuration, the stiffness of the heat sink member 31 can be enhanced by making the thickness T2 of the heat sink member 31 greater than the thickness T1 of the mounting substrate 21 which can in turn preserve the effective control of any warpage in the mounting substrate 21.

8) In the present embodiment, nothing is stated about the gas in the inner space of the globe 41. This gas may be air, or else a nitrogen gas may be sealed inside. As nitrogen gas is a better thermal conductor than air, even better heat dispersal characteristics can be achieved with a nitrogen gas sealed inside. Also, luminous deterioration due to moisture absorption by the LEDs and the phosphors can be prevented.

Note that the LED and phosphors may be prevented from absorbing moisture by evacuating all gas and creating a vacuum in the inner space of the globe 21.

Figure 16:
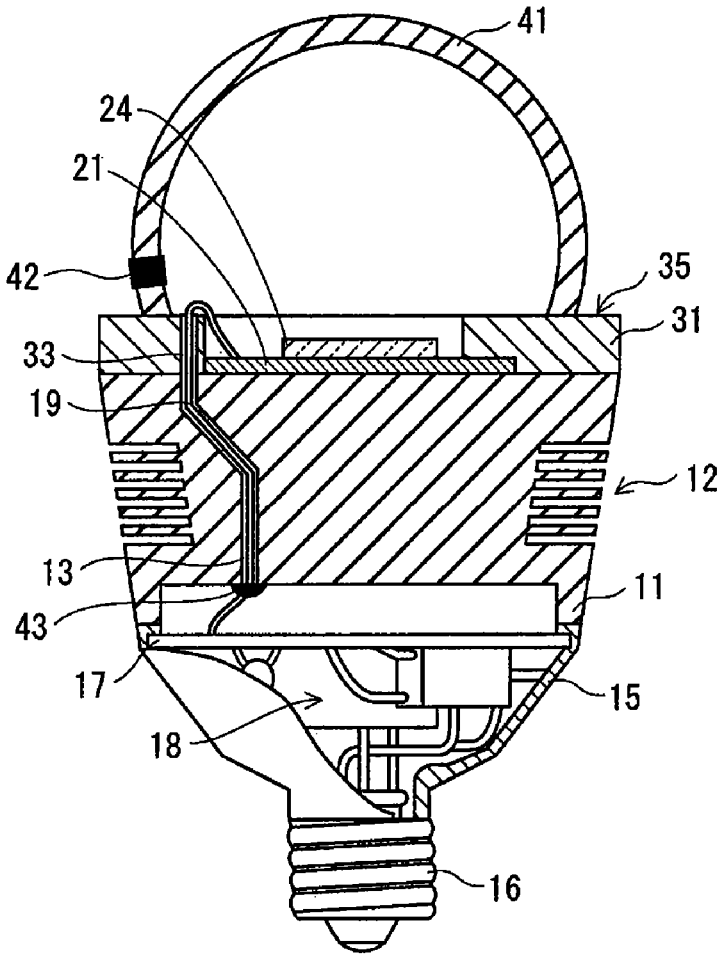
FIG. 16 shows a cross-section of the structure of the lamp pertaining to a variation of the present invention.
Figure 17:
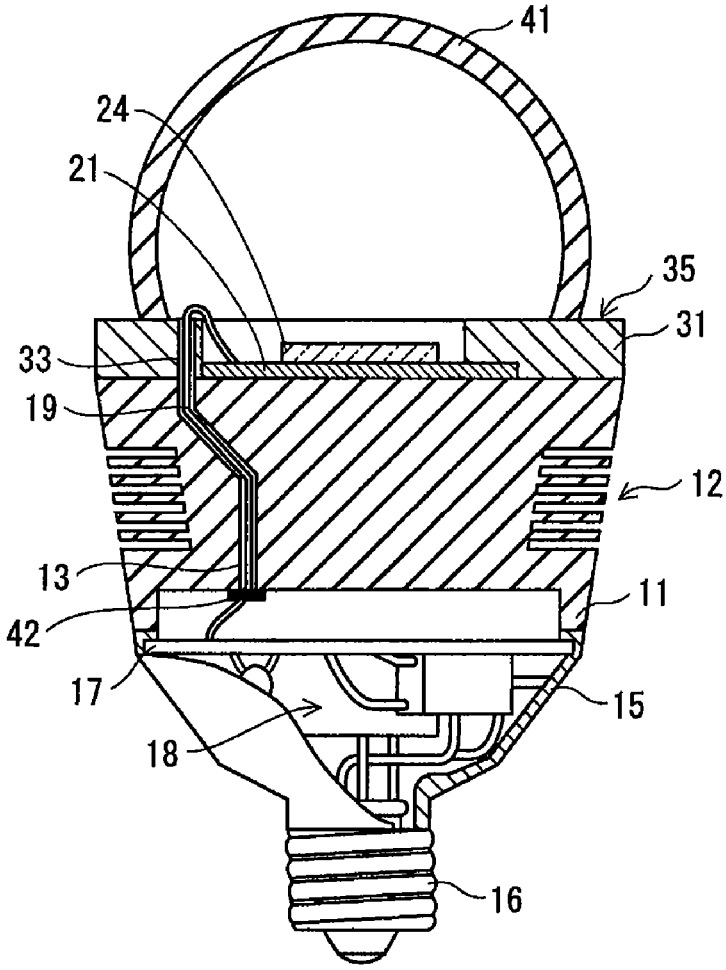
FIG. 17 shows a cross-section of the structure of the lamp pertaining to a variation of the present invention.
Figure 18:
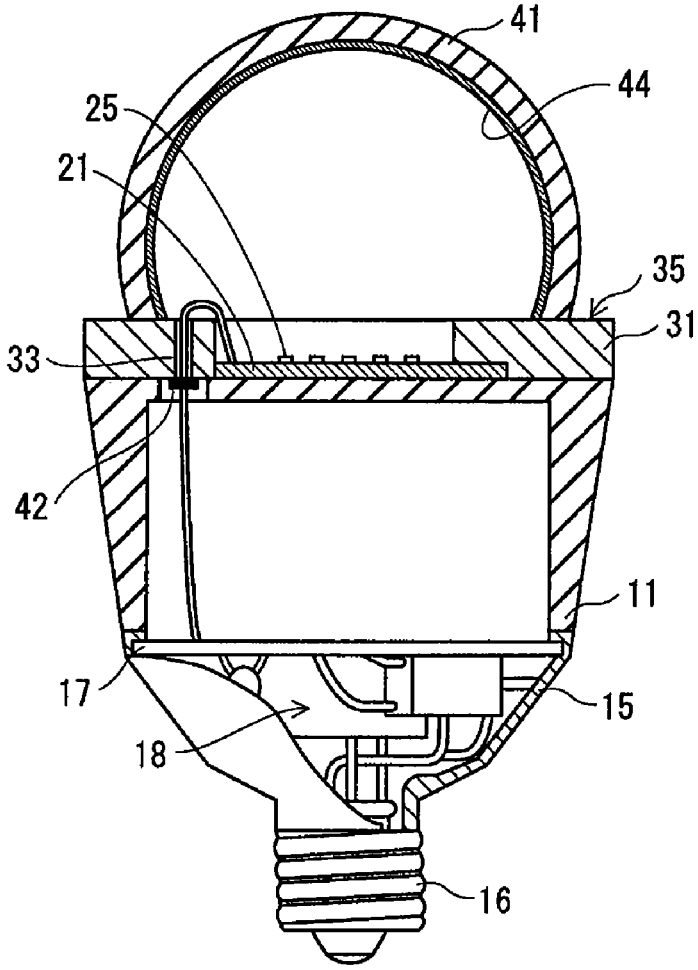
FIG. 18 shows a cross-section of the structure of the lamp pertaining to a variation of the present invention.

The sealing of the inner space of the globe 41 may be realized as shown in FIGS. 16, 17, and 18. In FIG. 16, the seal is realized via a sealer 43 that is applied to the opening of the through-hole 13 in the heat sink 11 plus a seal valve 42 on the globe 41. In FIG. 17, a seal valve 42 is placed at the opening of the through-hole 13. Also, in FIG. 18, a seal valve 42 is placed at the opening of the through-hole 33. A mechanical vacuum valve or similar part may, for example, be used as the seal valve 42. Glass, plastic, cement, or similar materials may be used as the sealer 43.

9) In the present embodiment, the LED 25 is sealed by a silicone resin body 26. However, the present invention is not limited in this way. For example, as shown in FIG. 18, the LED 25 may be exposed. In this configuration, the inner surface of the globe 41 has a phosphor layer 44 which allows white light to be produced, much like in the present embodiment. Also, in order to prevent moisture absorption by the LED and phosphors, it is desirable to seal nitrogen gas or dry air into the inner space of the globe 41, or else to evacuate all gas from inside and create a vacuum.

[Industrial Applicability]

The present invention can be used widely and generally in lighting applications.

[Reference Signs List]

1 lamp
11 heat sink member
12 fins
13 through-hole
14 top surface
15 case
16 Edison screw
17 printed circuit board
18 power supply circuit
19 wire
21 mounting substrate
22 metal substrate
23 insulating layer

24 light-emitting unit
25 LED
26 silicone resin body
27 electrode pads
28 perimeter
29 wiring pattern
31 heat sink member
32 aperture
33 through-hole
34 recess
35 perimeter
36 fins
37 gradually-widening inner surface
38 surface of the heat sink member
39 top surface of the light-emitting unit
41 globe
42 seal valve
43 sealer
44 phosphors
61 heat sink member
62 mounting substrate
64 light-emitting unit

The invention claimed is:

1. A bulb-type lighting source that receives electric power supplied via a base, comprising:

a bowl-shaped case which accommodates a power supply circuit in an inner space thereof and to which the base is attached;

a first heat sink member that closes a mouth of the bowl-shaped case;

a mounting substrate that is in surface contact with a front surface of the first heat sink member opposite a rear surface of the first heat sink member that faces the inner space of the bowl-shaped case;

a light-emitting unit that is mounted on a front surface of the mounting substrate opposite a rear surface of the mounting substrate which is in surface contact with the first heat sink member and that includes (i) a light-emitting element that emits light upon receiving electric power supplied by the power supply circuit and (ii) a wavelength conversion element that converts wavelengths of the light emitted by the light-emitting element;

a globe that at least covers the light-emitting unit in light emission directions thereof; and a second heat sink member that has a first part in surface contact with a region of the front surface of the mounting substrate where the light-emitting unit is not mounted and that has a second part in surface contact with the first heat sink member, wherein the first part of the second heat sink member is in: (i) surface contact with a perimeter region of the front surface of the mounting substrate in entirety, (ii) surface contact with the perimeter region of the front surface of the mounting substrate excluding a region where electrode pads are placed, or (iii) if the mounting substrate is a quadrilateral when viewed from an angle perpendicular to the mounting substrate, surface contact with three sides of the perimeter region of the front surface of the mounting substrate.

2. The bulb-type lighting source of claim 1, wherein at least one portion of the second heat sink member is not covered by the globe and is exposed to ambient air.

3. The bulb-type lighting source of claim 1, wherein the second heat sink member is flat-plate-shaped and has a recess formed in a principal surface thereof, the recess further continues from one portion thereof through to another principal surface of the second heat sink member and forms an aperture therein, the aperture accommodates the light-emitting unit therein, the first part of the second heat sink member is a part that has been made thin by the recess, and the second part of the second heat sink member is a part where the recess is not formed.

4. The bulb-type lighting source of claim 3, wherein an inner circumference of the aperture becomes greater while gradually approaching the other principal surface.

5. The bulb-type lighting source of claim 1, wherein a contact area between the second heat sink member and the mounting substrate is greater than a contact area between the light-emitting unit and the mounting substrate.

6. The bulb-type lighting source of claim 1, wherein the first part of the second heat sink member is thicker than the mounting substrate.

7. The bulb-type lighting source of claim 1, wherein the mounting substrate is composed of a metal substrate that is in surface contact with the front surface of the first heat sink member and an insulating layer that is layered on a partial region of a front surface of the metal substrate opposite a rear surface of the metal substrate that is in surface contact with the first heat sink member, the light-emitting unit is mounted on the insulating layer, and the first part of the second heat sink member is in surface contact with the front surface of the metal substrate in a region where the insulating layer is not layered.

8. The bulb-type lighting source of claim 1, wherein the globe is connected to the second heat sink member by screwing into a screw groove in the second heat sink member, or is joined to the second heat sink member by means of a thermally conducting joining material.

9. The bulb-type lighting source of claim 1, wherein a top part of the light-emitting unit protrudes beyond a surface of the second heat sink member in a direction perpendicular to the mounting substrate.

* * * * *